United States Patent [19]

Roland

[11] 4,419,028

[45] Dec. 6, 1983

[54] KNOCK DOWN CHAIR

[76] Inventor: Billy F. Roland, 37805 Maple Hill, Mt. Clemens, Mich. 48043

[21] Appl. No.: 273,470

[22] Filed: Jun. 15, 1981

Related U.S. Application Data

[62] Division of Ser. No. 125,691, Feb. 29, 1980, Pat. No. 4,348,052.

[51] Int. Cl.[3] ..... F16B 5/00

[52] U.S. Cl. ..... 403/353; 403/209

[58] Field of Search ..... 403/353, 209

[56] References Cited

U.S. PATENT DOCUMENTS

| | | | |
|---|---|---|---|
| 1,255,406 | 2/1918 | Gilbert | 403/353 |
| 2,279,864 | 4/1942 | Eide | 297/442 X |
| 2,486,987 | 11/1949 | Scarlett | 297/442 |

FOREIGN PATENT DOCUMENTS

| | | | |
|---|---|---|---|
| 501326 | 2/1939 | United Kingdom | 403/353 |

*Primary Examiner*—Andrew V. Kundrat

*Attorney, Agent, or Firm*—Basile, Weintraub & Hanlon

[57] ABSTRACT

A knock down chair made from an assembly of interlocking planar members requiring no fasteners is disclosed. The various members can be made from a single sheet of commercially available plywood and include first and second side members, a seat member, a pair of transverse seat support members, and a back member. The transverse seat support members are rotatingly interlocked to the side members, and the seat member is interlocked to the side members to hold the side members, the seat support members, and the seat in interlocking relationship. The back member is interlocked to the side members to complete the assembly.

2 Claims, 8 Drawing Figures

Fig-4
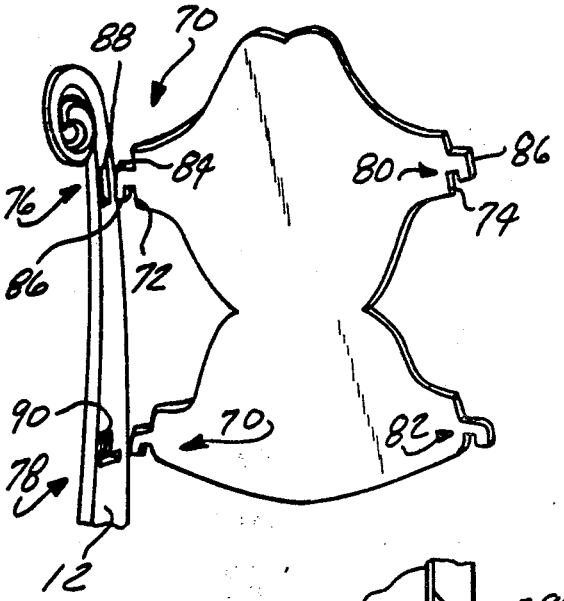
Fig-7
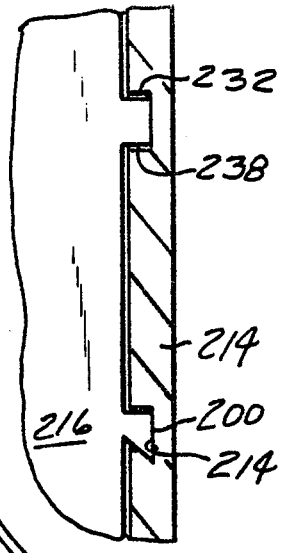
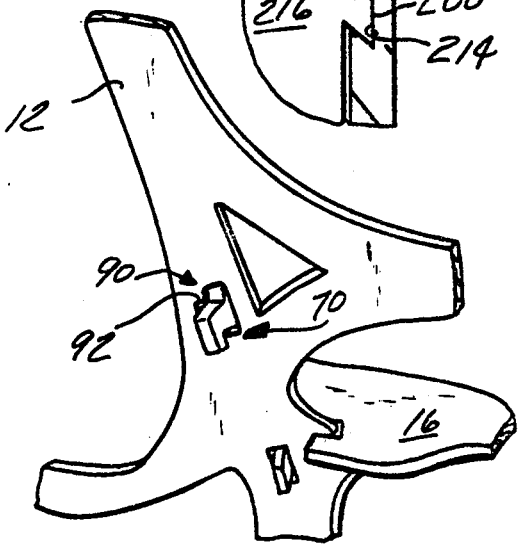
Fig-5
Fig-8
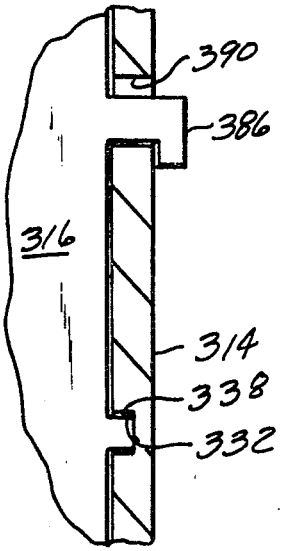
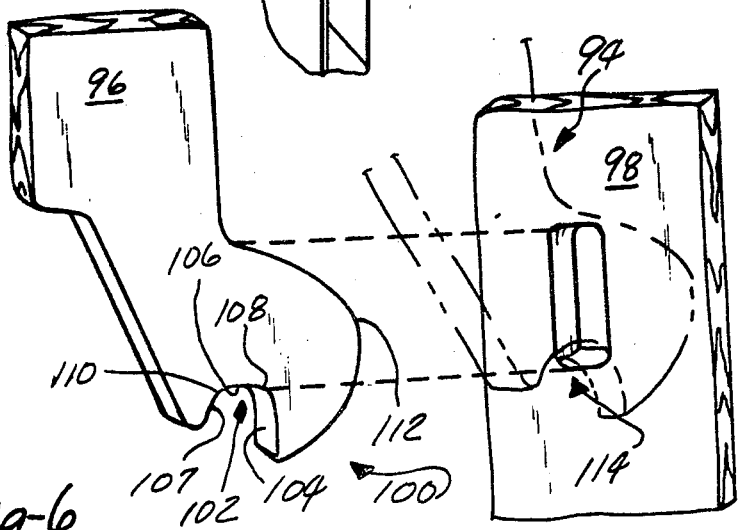
Fig-6

KNOCK DOWN CHAIR

This application is a division of application Ser. No. 125,691, filed Feb. 29, 1980, now U.S. Pat. No. 4,348,052.

BACKGROUND OF THE INVENTION

I. Field of the Invention

The present invention generally relates to the field of furniture, and in particular, the present invention is concerned with a chair having members formed from a single sheet of conventional plywood and are assembled into interlocking relationship requiring no fasteners for the assembly. The chair can be readily disassembled and knocked down into compact form for storage, transportation, or packaging.

II. Description of the Prior Art

Furniture of the knock down type that may be readily disassembled for storage and/or transportation or packaging has long been known. Usually the knock down furniture in the prior art employs fasteners of various types including threaded fasteners, dowels, or wedges to align and join the various parts into a completed assembly. Examples of knock down furniture using dowels, threaded fasteners, wedges, or the like in the prior art are disclosed in U.S. Pat. No. 3,845,988; 3,870,366; and 4,140,065. U.S. Pat. No. 4,091,746 discloses a knock down article of furniture comprising components joined by tonque and groove and dovetail joints enabling the individual components to be merely pressed together to form the complete furniture article. These patents are relevant to the Applicant's invention in that they represent the closest prior art for assembling knock down furniture.

III. Prior Art Statement

The aforementioned prior art, in the opinion of the Applicant and the Applicant's Attorney represents the closest prior art of which the Applicant and his Attorney are aware.

SUMMARY OF THE INVENTION

The present invention, which will be described in greater detail hereinafter, comprises a knock down chair made from an assembly of interlocking planar members requiring no fasteners, wedges, dowels, or other devices to assemble various components of the chair into an interlocking assembly. The knock down chair of the present invention comprises a first side member and a second side member; a seat member; a pair of transverse seat support members; and a back member, with the various members cojoined into an interlocking assembly requiring no fasteners.

The pair of transverse seat support members are rotatingly locked to the first and second side members by a pair of opposed rotatingly engageable hook flanges integral with the opposed side members. Each rotatingly engageable hook flange is rotatingly and snugly engageable with a corresponding first rectangular opening formed in each of the first and second side members. A first pair of opposed transverse flanges spaced above the pair of opposed hook flanges are integral with the transverse seat support members and are aligned and snugly engageable with a second rectangular opening formed in the first and second side members. An access opening formed in the side members is configured to accommodate a pair of opposed side member engaging openings formed along opposed outer edges of the seat member. When the opposed side member engaging openings of the seat are engaged with the side member, the pair of transverse seat support members, the first and second side members, and the seat member are in interlocking engagement.

The back member is secured to the first and second side members by a first pair of spaced apart hook flanges disposed along a first side edge of the back member and a second pair of spaced apart hook flanges disposed along a second side edge of the back member. An upper opening and a lower opening formed in the first and second side members are aligned and snugly engageable with a corresponding pair of spaced apart hook flanges which are employed to interlockingly secure the back member to the first and second side members.

It is therefore a primary object of the present invention to provide a new and improved knock down chair.

It is a further object of the present invention to provide such a knock down chair which requires no fasteners for its assembly.

It is yet another object of the present invention to provide a new and improved knock down chair having components of a planar configuration that can be formed from a standard sized sheet of plywood.

It is yet a further object of the present invention to provide a new and improved knock down chair having interlocking joints arranged to prevent an accidental disassembly of the chair.

Further objects, advantages, and applications of the present invention will become apparent to those skilled in the art of knock down furniture when the accompanying description of one example of the best mode contemplated for practicing the invention is read in conjunction with the accompanying drawing.

BRIEF DESCRIPTION OF THE DRAWING

In the drawing, like reference numbers refer to like parts throughout the several views, and wherein:

FIG. 4 illustrates a perspective view of the hook flange of the back member;

FIG. 5 illustrates a perspective view of the lower opening formed in the side member;

FIG. 6 illustrates a perspective view of a joint for rotatingly interlocking a pair of perpendicular walls;

FIG. 7 illustrates a cross section of an alternate form of rotating interlocking joints; and FIG. 8 illustrates a cross section of an alternate form of interlocking hook joint.

DESCRIPTION OF THE PREFERRED EMBODIMENT

Figure 1:
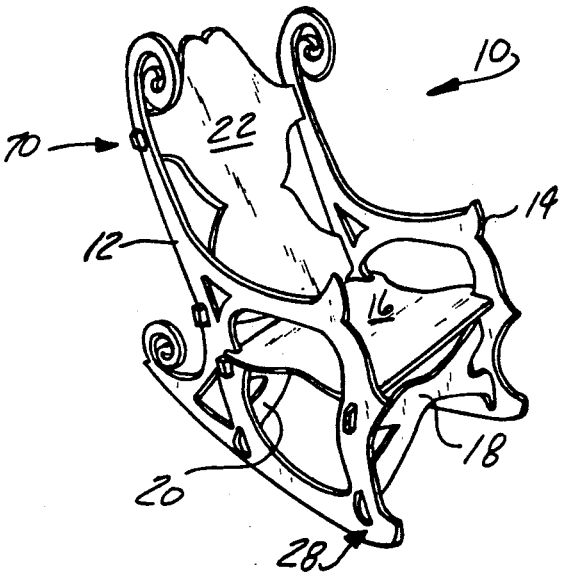
FIG. 1 illustrates a perspective view of the chair of the present invention.

Referring now to the drawing and in particular FIG. 1, there is illustrated at 10 one example of the present invention in the form of a knock down rocking chair. The knock down chair 10 is adapted to be made from an assembly of interlocking planar members requiring no fasteners to be assembled and includes a first side member 12 and a second side member 14; a seat member 16; a pair of transverse seat support member 18,20 rotatingly interlocked to the side members 12 and 14; and a back member 22 interlockingly engaged with the side members 12,14.

Figure 2:
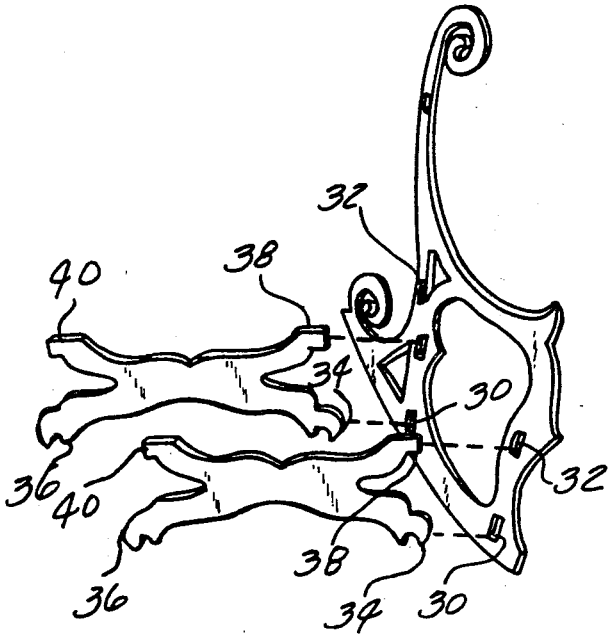
FIG. 2 illustrates a perspective view of the rotatingly engageable hook flanges of the present invention for joining the transverse seat support members to the side members.

A first locking means 28 is provided for rotatingly locking the transverse seat support members 18,20 to the first and second side members 12,14. The means 28 comprises a first pair of spaced apart rectangular openings 30 (FIG. 2) formed in the first and second side members 12,14 proximate a lower edge thereof, and a second pair of spaced apart rectangular openings 32 spaced above the first pair of rectangular openings 30. A pair of opposed rotatingly engageable hook flanges 34,36 are formed at an outer lower portion of each transverse seat support member 18,20 with each rotatingly engageable hook flange rotatingly and snugly engageable with a corresponding first rectangular opening 30. A first pair of opposed transverse flanges 38,40 are spaced above the pair of opposed rotatingly engageable hook flanges 34,36 and align and are snugly engageable with its corresponding second rectangular opening. When the hook flanges 34,36 and the opposed transverse flanges 38,40 are engaged with the first and second rectangular openings, each transverse seat support member 18,20 is interlocked with its corresponding side member 12,14 and the side members are spaced apart and parallel assuming an upright position.

Figure 3:
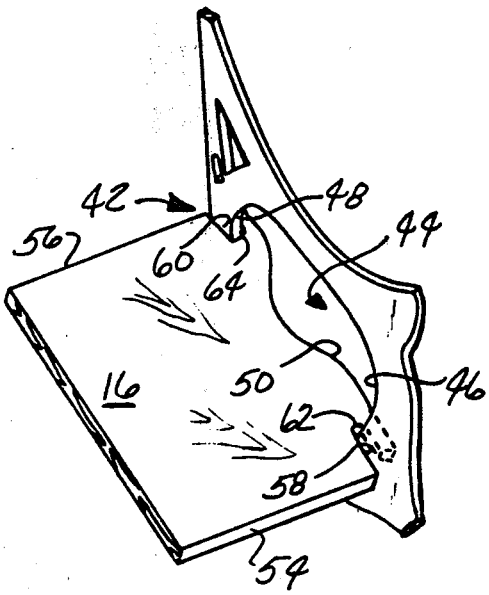
FIG. 3 illustrates a perspective view of the seat member joined to the side member.

A second locking means 42 is provided for securing the seat member 16 to the first and second side members 12,14 in an interlocking relationship which prevents rotation of the side members relative to the transverse seat support members and a resulting disengagement of the side members from the transverse seat support members. The second locking means 42 comprises (FIG. 3) an access opening 44 having opposed front and rear edges 46,48 formed in the first and second side members 12,14. The seat member 16 includes opposed outer edges 50,52 and a forward edge 54 and a rearward edge 56. A pair of opposed side member engaging openings 58,60 are provided having open ends at the forward and rearward edges respectively. The opposed openings 58,60 are formed inward from each of the opposed outer edges 50,52 and are snugly engageable with the first and second side members 12,14. Each side member engaging opening 58,60 includes an opening inner edge 62,64 abutting an opposed edge of the access opening 44. When the side member engaging opening 58,60 are engaged with the side member 12,14 the seat is supported by the transverse seat support members 18,20 and the side members 12,14 are held in a spaced apart parallel relationship with the seat 16 preventing rotation of the side members relative to the transverse seat support members and a resulting disengagement of the side members from the transverse seat support members.

A third locking means 70 is provided for securing the back member 22 to the first and second side members 12,14 as illustrated in FIGS. 4 and 5. The back member 22 includes a first side edge 72 and a second side edge 74, and the third locking means 70 comprises a first pair of spaced hook flanges 76,78 disposed along the first side edge 72, and a second pair of spaced hook flanges 80,82 disposed along the second side edge 74. The first and second pairs of hook flanges comprise an upper portion 84 projecting outward and integral with its corresponding side edge, and an outer portion 86 extending downward from and integral with the upper portion spaced outward from its corresponding side edge. An upper opening 88 and a lower opening 90 are formed in each of the first and second side members aligned with and snugly engageable with a corresponding pair of spaced hook flanges. The lower opening 90 includes a rearward extending opening 92 in communication with the lower opening and positioned at a lower end thereof configured to snugly engage the hook flange upper portion 84. When the hook flange outer portion 86 has engaged the lower opening 90 it is then displaced downward to align the upper portion 84 with the rearward extending opening 92. The upper portion 84 is then displaced rearward to snugly engage the upper portion in the rearward extending opening interlocking the back member and its corresponding side member.

A joint 94 for rotatingly interlocking a first wall 96 intersecting with a second wall 98 may be employed as illustrated in FIG. 6 of the drawing. The joint 94 comprises a rotatable hook member 100 projecting from the first wall 96 including a recess 102 having an upward extending outer wall 104, a top wall 106 perpendicular to the outer wall extending inward a distance, and an inner wall 107 extending inward and downward from the top wall. A first corner 108 is defined by an intersection of the outer wall 104 and the top wall 106, and a second corner 110 is defined by an intersection of the top wall 106 and the inner wall 107. An arcuate outside edge 112 defines an outer end of the hook member 100 and comprises an arc of constant radius having a center proximate the first corner beginning at a lower end of the outside edge and extending upward in an arcuate manner to a point vertically above the second corner 110. A hook member engaging opening 114 is formed in the second wall 98 having a width to snugly engage the rotatable hook member and a height proximate the radius of the arcuate outside edge 112. The first wall 96 and the second wall 98 are rotatingly interlocked by inserting the rotatable hook member 100 into the hook member engaging opening 114 and rotating the first wall about the center.

Another form of a rotating interlocking joint for joining a transverse seat support member 216 to a side member 214 is illustrated in FIG. 7. A blind hook flange 200 is engageable with a complementary blind aperture 214 and a blind transverse flange 238 is engageable with a complementary upper blind aperture 232 to secure the member 216 to the member 214. It is obvious to the skilled artisan that a pair of spaced blind transverse flanges 238 could also be employed to engage a pair of blind apertures 232.

FIG. 8 illustrates another form of interlocking joint that may be employed to interlock a member 316 to a side member 314 employing a hook joint 386 engaging an aperture 390. A blind lower flange 338 is engageable with a complementary blind lower aperture 332 to secure member 316 to member 314.

The various members which comprise the rocking chair 10 may be conveniently cut from a single sheet of commercially available plywood. In this manner the rocking chair 10 can be produced in a very economical low cost manner.

It can thus be seen that the present invention has provided a new and improved knock down rocking chair wherein a chair can be formed from components cut from a single sheet of commercially available plywood. It can be readily ascertained by a person skilled in the art to which this invention pertains, that a rocking chair can be very economically produced by employing the teachings of the present invention with the generation of very little waste material.

It should be understood by those skilled in the art of knock down furniture that other forms of the Applicant's invention may be had, all coming within the spirit of the invention and the scope of the appended claims.

Having thus described my invention what I claim is:

1. A joint for rotatingly interlocking a first wall and a second wall with the walls disposed perpendicular to each other comprising:

a first locking means including:

a rotatable hook member projecting from the first wall comprising a recess having an upward extending outer wall, a top wall perpendicular to the outer wall extending inward a distance, and an inner wall extending inward and downward from the top wall, a first corner defined by an intersection of the outer wall and the top wall;

a second corner defined by an intersection of the top wall and the inner wall;

an arcuate outside edge having an arc of constant radius with a center proximate the first corner beginning at a lower end of the outer edge and extending to a point vertically above the second corner;

a hook member engaging opening formed in the second wall having a width to snugly engage the rotatable hook member and a height proximate the radius;

a second locking means comprising a rectangular opening formed in said second wall spaced from said hook member engaging opening, a transverse flange projecting from said second wall aligned with and snugly engageable with said rectangular opening; and wherein the walls are rotatingly interlocked by inserting the rotatable hook member into the hook member engaging opening and rotating the first wall about the center, and when said walls are rotatingly interlocked said transverse flange is engaged with said rectangular opening preventing rotation of said second wall relative to said first wall along an axis normal to the rotational axis for interlocking said walls.

2. A joint for interlocking a pair of intersecting walls comprising:

a first wall and a second wall;

said first wall comprising a hook projection configured to rotate within an aperture to interlock therewith and an axial flange projection extending from a common edge;

said second wall having a first polygonal opening with a height approximately the radius of the outside edge of said hook projection to rotatingly receive said hook projection, and a second polygonal opening spaced from said first opening to slidingly receive said flange projection upon said common edge being engaged with said second wall; and whereby the pair of walls are interlocked when said hook projection is rotatingly inserted into said first opening and said flange projection is inserted into said second opening and whereby relative rotation of said first and second walls along an axis normal to said second wall is prevented.

* * * * *